US005939366A

United States Patent [19]

MacNeil et al.

[11] Patent Number: 5,939,366

[45] Date of Patent: Aug. 17, 1999

[54] LUBRICATION PROCESS USING CHLORINE-FREE LUBRICANT

[75] Inventors: James MacNeil, New Philadelphia; Donald R. Stevenson, Dover; Barbara A. Wade, Dalton; Joseph C. Fette, New Philadelphia, all of Ohio

[73] Assignee: Dover Chemical Corp., Dover, Ohio

[21] Appl. No.: 09/031,305

[22] Filed: Feb. 26, 1998

Related U.S. Application Data

[62] Division of application No. 08/897,382, Jul. 21, 1997, Pat. No. 5,780,400, which is a continuation of application No. 08/726,046, Oct. 7, 1996, abandoned.

[51] Int. Cl.[6] ..... C10M 129/72

[52] U.S. Cl. ..... 508/496

[58] Field of Search ..... 508/496

[56] References Cited

U.S. PATENT DOCUMENTS

| | | | |
|---|---|---|---|
| 3,172,897 | 3/1965 | Rai et al. | 260/410 |
| 3,483,122 | 12/1969 | MacPhail et al. | 252/46.6 |
| 3,585,137 | 6/1971 | Bosniack et al. | 252/32.5 |
| 3,720,612 | 3/1973 | Bosalack et al. | 252/32.5 |
| 3,986,965 | 10/1976 | Clark et al. | 252/32.5 |
| 5,254,276 | 10/1993 | Benjamin et al. | 252/49.8 |
| 5,284,592 | 2/1994 | Aberkane et al. | 252/48.006 |
| 5,318,711 | 6/1994 | Evans et al. | 252/34 |
| 5,318,712 | 6/1994 | Lange et al. | 252/47.5 |
| 5,414,103 | 5/1995 | Cracknell et al. | 558/90 |

FOREIGN PATENT DOCUMENTS 62-178259 8/1987 Japan .

OTHER PUBLICATIONS

Published International Search Report by the European Patent Office.

*Primary Examiner*—Jacqueline V. Howard
*Attorney, Agent, or Firm*—Oldham & Oldham Co., L.P.A.

[57] ABSTRACT

The invention pertains to chlorine-free extreme pressure metalworking fluid additives and lies in the recognition of the improved hydrolytic stability of alkanoic acid esters of cyclohexane dimethanol and other esters embodying similar structures. The various derivatives which are effective as extreme pressure additives include those which fall within the generic description wherein $R^1$ through $R^4$ are independently selected from the group hydrogen and $C_{1-24}$ hydrocarbyl groups and $R^5$ and $R^6$ are independently selected from the group $C_{3-24}$ hydrocarbyl groups.

16 Claims, 4 Drawing Sheets

LUBRICATION PROCESS USING CHLORINE-FREE LUBRICANT

This application is a division of U.S. application Ser. No. 08/897,382 filed Jul. 21, 1997, now U.S. Pat. No. 5,780,400 which is a continuation of U.S. application Ser. No. 08/726,046, filed Oct. 7, 1996, now abandoned.

The invention described herein pertains generally to chlorine-free extreme pressure metalworking fluid additives.

BACKGROUND OF THE INVENTION

Lubrication involves the process of friction reduction, accomplished by maintaining a film of a lubricant between two surfaces which are moving with respect to each other. The lubricant prevents contact of the moving surfaces, thus greatly lowering the coefficient of friction. Since lubricants for different uses operate under different conditions, numerous additives have been developed to establish or enhance various properties of lubricants. Representative types of additives which are used include viscosity improvers, detergents, dispersants, antioxidants, extreme pressure additives, corrosion inhibitors and others. Frequently, combinations of additives are required.

Of particular importance in many applications are anti-wear agents, many of which function by a process of interaction with the surfaces, thereby providing a chemical film which prevents metal-to-metal contact under high load conditions. Wear inhibitors which are useful under extremely high load conditions are frequently called "extreme pressure agents". These extreme pressure agents are frequently selected from the following chemical types: zinc organodithiophosphates; sulfurized olefins, chlorinated waxes; amine salts of phosphate esters; phosphites; and others. Certain of these materials, however, must be used judiciously in certain applications due to their property of accelerating corrosion of metal parts, such as bearings. In addition, some applications require very low concentrations of certain elements, such as phosphorus, which restricts the utility of otherwise quite useful extreme pressure agents.

There are several commercially available products which are extreme pressure fluid additives. These would include a proprietary synthetic ester, offered by Gateway under the tradename Syn-ester. Examples of chlorine-free additives would include Keil's Klor-free 427, a blend of phosphate esters and sulfurized lard oil, Dover Chemicals's NCL-2, a blend of petroleum sulfonate, phosphorus acid, and a long chain amine, and Mayfree, offered by Mayco, a blend of sulfurized fat and phosphate esters. Other prior art synthetic ester lubricating oil compositions would include those described in U.S. Pat. No. 3,720,612, U.S. Pat. No. 3,585,137, U.S. Pat. No. 3,483,122 and U.S. Pat. No. 3,986,965.

SUMMARY OF THE INVENTION

In accordance with the present invention, there is provided a new class of esters which offers performance on the Falex pin-and-vee test that is equal or superior to the above products.

It is an object of this invention to provide a synthetic ester which offers a higher degree of hydrolytic stability when compared to Gateway's Syn-ester. This is achieved in a preferred embodiment, by the incorporation of an additive which is the heptanoic acid ester of cyclohexane dimethanol and other esters embodying similar structures.

These and other objects of this invention will be evident when viewed in light of the drawings, detailed description, and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
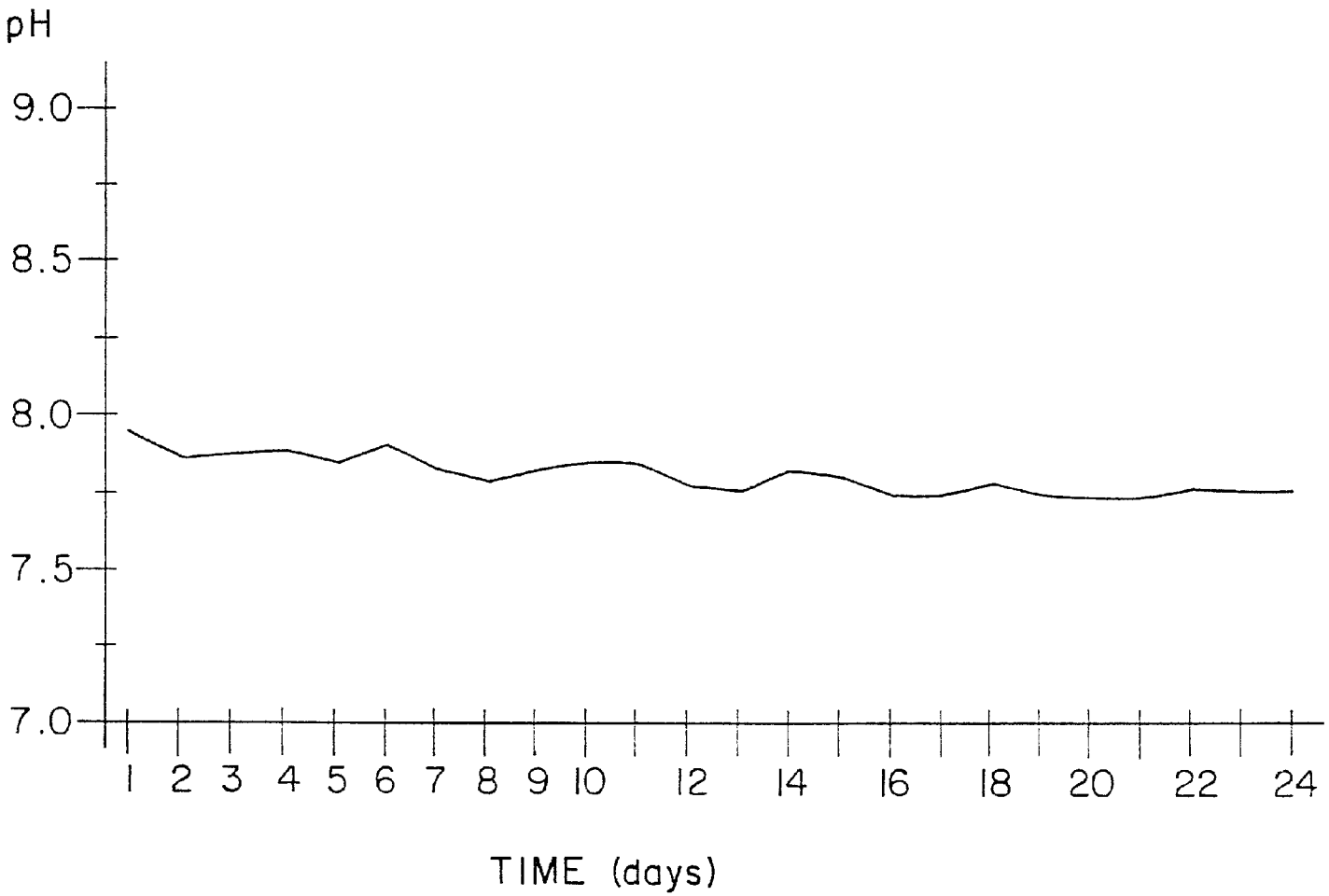
FIG. 1 is plot of pH over time (days) of a 10% by weight aqueous solution of cyclohexanedimethanol diheptanoate from a starting pH of 7.95.

The best mode for carrying out the invention will now be described for the purposes of illustrating the best mode known to the applicant at the time. The examples are illustrative only and not meant to limit the invention.

The invention lies in the recognition of the improved hydrolytic stability of alkanoic acid esters of cyclohexane dimethanol and other esters embodying similar structures. Specifically, the preferred ester is the reaction product of cyclohexane dimethanol with heptanoic acid.

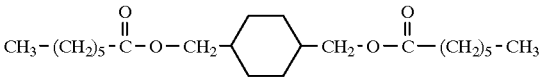

In this application, the term "hydrocarbyl" will be used, and for the purposes of definition, will include hydrocarbon, as well as substantially hydrocarbon groups. Substantially hydrocarbon describes groups which contain hetero atom substituents which do not alter the predominantly hydrocarbon nature of the group. Examples of hydrocarbyl groups include the following: (1) hydrocarbon substituents, this is aliphatic (e.g., alkyl or alkenyl), alicyclic (e.g., cycloalkyl, cycloalkenyl) substituents, aromatic-substituted aliphatic substituents or aromatic-substituted alicyclic substituents, or aliphatic- and alicyclic-substituted aromatic substituents and the like, as well as cyclic substituents wherein the ring is completed through another portion of the molecule (that is, for example, any two indicated substituents may together form an alicyclic radical); (2) substituted hydrocarbon substituents, that is, those substituents containing non-hydrocarbon groups which, in the context of this invention, do not alter the predominantly hydrocarbon nature of the substituent; those skilled in the art will be aware of such groups (e.g., hydroxy, mercapto, nitroso, nitro, sulfoxy, etc.); and (3) hetero atom substituents, this is, substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those skilled in the art and include, for example, sulfur, oxygen, nitrogen and such substituents as, e.g., pyridyl, furyl, thienyl, imidazolyl, etc. In general, no more than one hetero atom substituent will be present for every ten carbon atoms in the hydrocarbyl group. Typically, there will be no such heteroatom substituents in the hydrocarbyl group, and in a preferred embodiment, the hydrocarbyl group will be purely hydrocarbon.

In a general sense, the various derivatives which are effective as extreme pressure additives include those which fall within the generic description shown below;

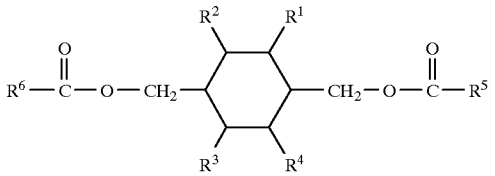

wherein $R^1$ through $R^4$ are independently selected from the group hydrogen and $C_{1-24}$ hydrocarbyl groups, and $R^5$ and R6 are independently selected from the group $C_{3-24}$ hydrocarbyl groups. The additives are made using esterification reaction technology as is known in the art.

In a more preferred embodiment, $R^1$ through $R^4$ are independently selected from the group hydrogen and $C_{1-24}$ alkyl groups and $C_{1-24}$ cycloalkyl groups; and $R^5$ and $R^6$ are independently selected from the group $C_{3-24}$ alkyl groups.

In a most preferred embodiment, $R^1$ through $R^4$ are hydrogen; and $R^5$ and $R^6$ are independently selected from the group $C_{3-24}$ alkyl groups.

Aqueous metalworking fluid compositions were prepared and the results summarized in Table 1 based on the ASTM D-3233 and ASTM E-686 testing protocols. The Falex pin-and-vee block tester, was used as the measurement of lubricity (ASTM D-3233). A simple Falex ER (extreme pressure) load and friction test was used. A cleaned #8 steel pin and blocks were placed in the machine and the reservoir was filled with test fluid. After a one minute break-in period at a load of 250 lbs., the ratchet arm was engaged and the load was allowed to walk up to successively higher levels until failure occurred. The torque is a measurement of friction and boundary layer lubrication, with lower torque levels being desirable. The level of the failure load indicates EP performance of the metalworking fluid, with high levels being desirable. Failure occurs upon seizing, due to a lack of lubrication, with concurrent snapping of the pin. Table #1 indicates the performance of the metalworking fluids formulated.

A summary of the results of testing various esters in comparison to the extreme pressure additives of the instant invention is tabularized in Table 1.

TABLE 1

| Compound | Load | Torque (in-lbs) | Final Temp |
|---|---|---|---|
| 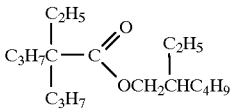 2-ethylhexyl neodecanoate | 1250 | 40 | 96° F. |
| 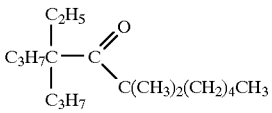 isooctyl neodecanoate | 500 | 25 | 115° F. |
| 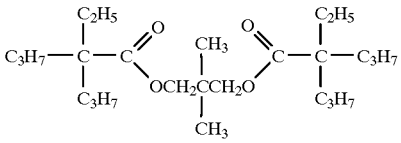 NPG dineodecanoate | 500 | 26 | 102° F. |
| 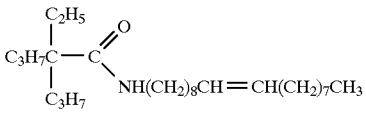 neodecanoic oleylamide | pin broke before warm up was over | | |
| 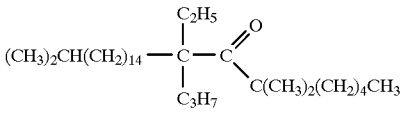 isooctyl isostearate | 500 | 16 | 102° F. |

TABLE 1-continued

| Compound | Load | Torque (in-lbs) | Final Temp |
|---|---|---|---|
| $(CH_3)_2CH(CH_2)_{14}C(=O)O(CH_2)_7CH_3$ octyl isostearate | 500 | 18 | 100° F. |
| $CH_2{=}CH(CH_2)_8C(=O)O(CH_2)_{11}CH_3$ lauryl undecylenoate | 750 | 34 | 94° F. |
| $CH_3(CH_2)_{11}OC(=O)(CH_2)_7C(=O)O(CH_2)_{11}CH_3$ dilauryl azelate | 4,500+ | 120 | 224° F. |
| $CH_3(CH_2)_{11}OC(=O)(CH_2)_7C(=O)O(CH_2)_{11}CH_3$ dilauryl azelate (10% in oil) | 750 | 26 | 91° F. |
| $CH_3(CH_2)_5C(=O)O(CH_2)_{11}CH_3$ heptyl laurate | 1000 | 48 | 92° F. |
| $CH_3(CH_2)_7CH{=}CH(CH_2)_7C(=O)OCH_2$–(cyclohexane)–$CH_2OC(=O)(CH_2)_7CH{=}CH(CH_2)_7CH_3$ CHDM dioleate | 750 | 30 | 93° F. |
| $CH_3(CH_2)_5C(=O)OCH_2$–(cyclohexane)–$CH_2OC(=O)(CH_2)_5CH_3$ CHDM diheptanoate | 4500+ | 71 | 170° F. |
| $CH_3(CH_2)_5C(=O)OCH_2$–(cyclohexane)–$CH_2OC(=O)(CH_2)_5CH_3$ CHDM diheptanoate (10% in oil) | 4500+ | 89 | 179° F. |
| $CH_3(CH_2)_5C(=O)OCH_2$–(cyclohexane)–$CH_2OC(=O)(CH_2)_5CH_3$ CHDM diheptanoate (5% in oil) | 4500+ | 90 | 191° F. |

TABLE 1-continued
| Compound | Load | Torque (in-lbs) | Final Temp |
|---|---|---|---|
| 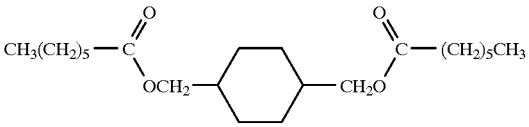 CHDM diheptanoate (4% in oil) | 4500+ | 88 | 230+ ° F. |
| 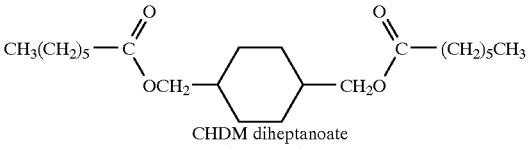 CHDM diheptanoate (3% in oil) | 750 | 31 | 102° F. |
| 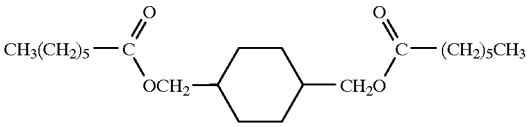 CHDM diheptanoate (2% in oil) | 750 | 30 | 118° F. |
| $C_{17}H_{34}CO_2(CH(CH_3)CH_2O)_7OH$ SAPPG 400 | 4500+ | 77 | 185° F. |
| $C_{17}H_{32}CO_2(CH(CH_3)CH_2O)_7H$ OAPPG 400 | 750 | 31 | 99° F. |
| 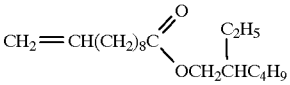 2-ethylhexyl undecylenoate | 4500+ | 69 | 176° F. |
| 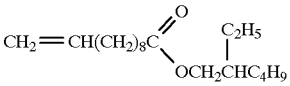 2-ethylhexyl undecylenoate (10% in oil) | 4500+ | 83 | 210° F. |
| 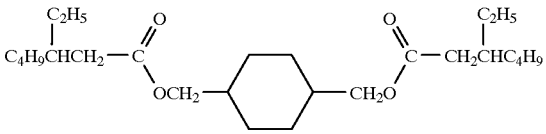 CHDM di-2-ethylhexanoate | 4500+ | 106 | 221° F. |
| 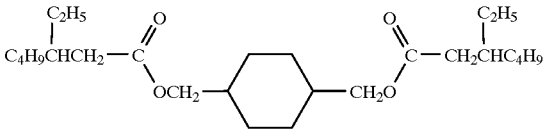 CHDM di-2-ethylhexanoate (10% in oil) | 750 | 38 | 100° F. |
| 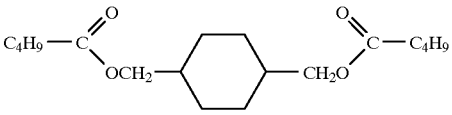 CHDM butyrate | 4500+ | 83 | 184° F. |

TABLE 1-continued

| Compound | Load | Torque (in-lbs) | Final Temp |
|---|---|---|---|
| 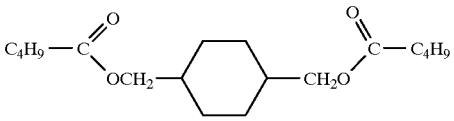 CHDM butyrate (10% in oil) | 1000 | 40 | 105° F. |
| Gateway Syn-Ester (5% in oil) | 2000 | 31 | 96° F. |

As can be seen from the table, the use of the esterification product of alkanoic acids with cyclohexane dimethanol resulted in an extreme pressure additive which possessed superior lubricity (4500+) and low torque, when compared to other esters. Additionally, as seen by the final temperature, the esterification product showed efficacy as a coolant as seen by the lower temperature readings observed.

Figure 2:
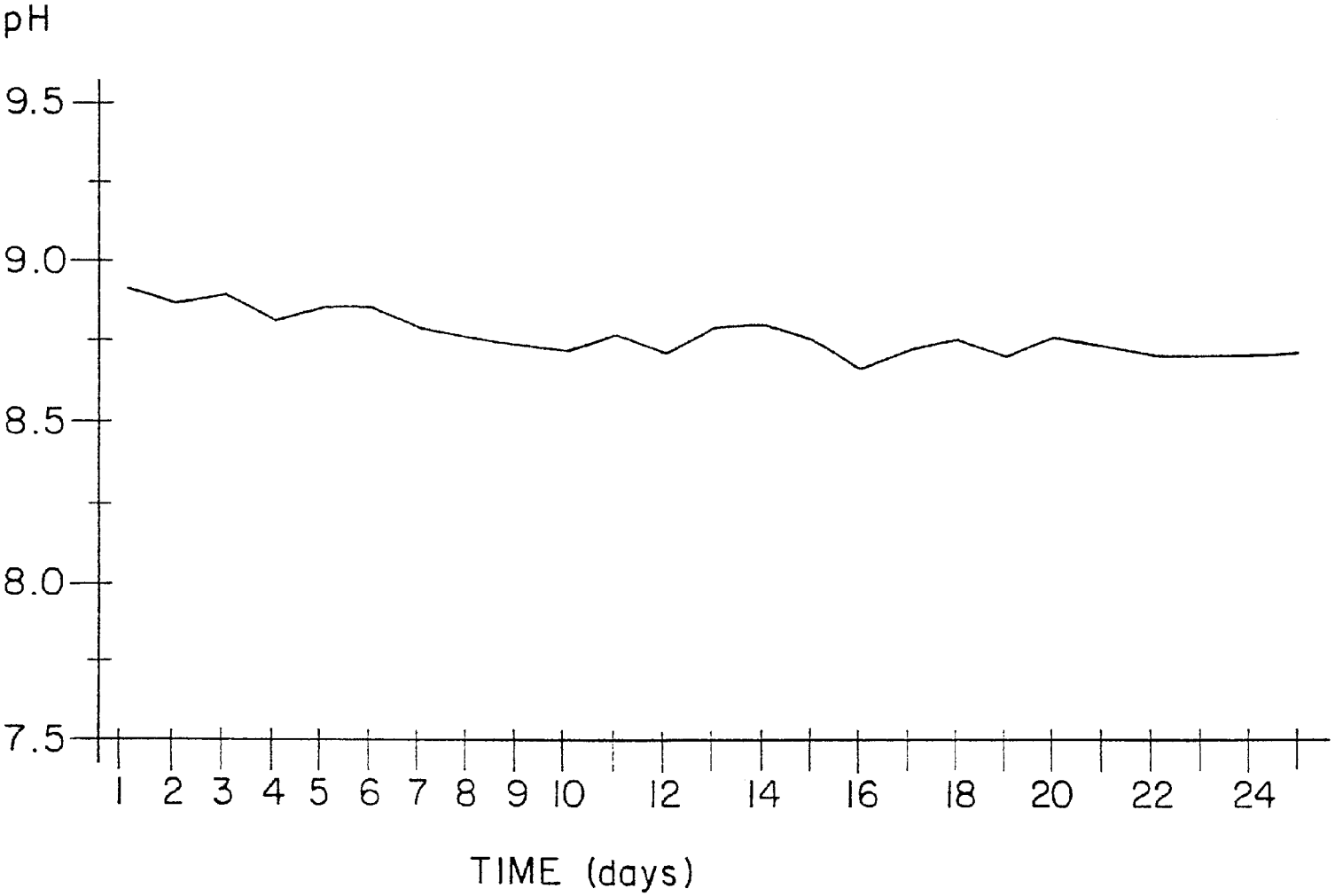
FIGS. 2 and 3 are plots similar to that described for FIG. 1, except that the starting pH is 8.91 and 9.77 respectively.
Figure 3:
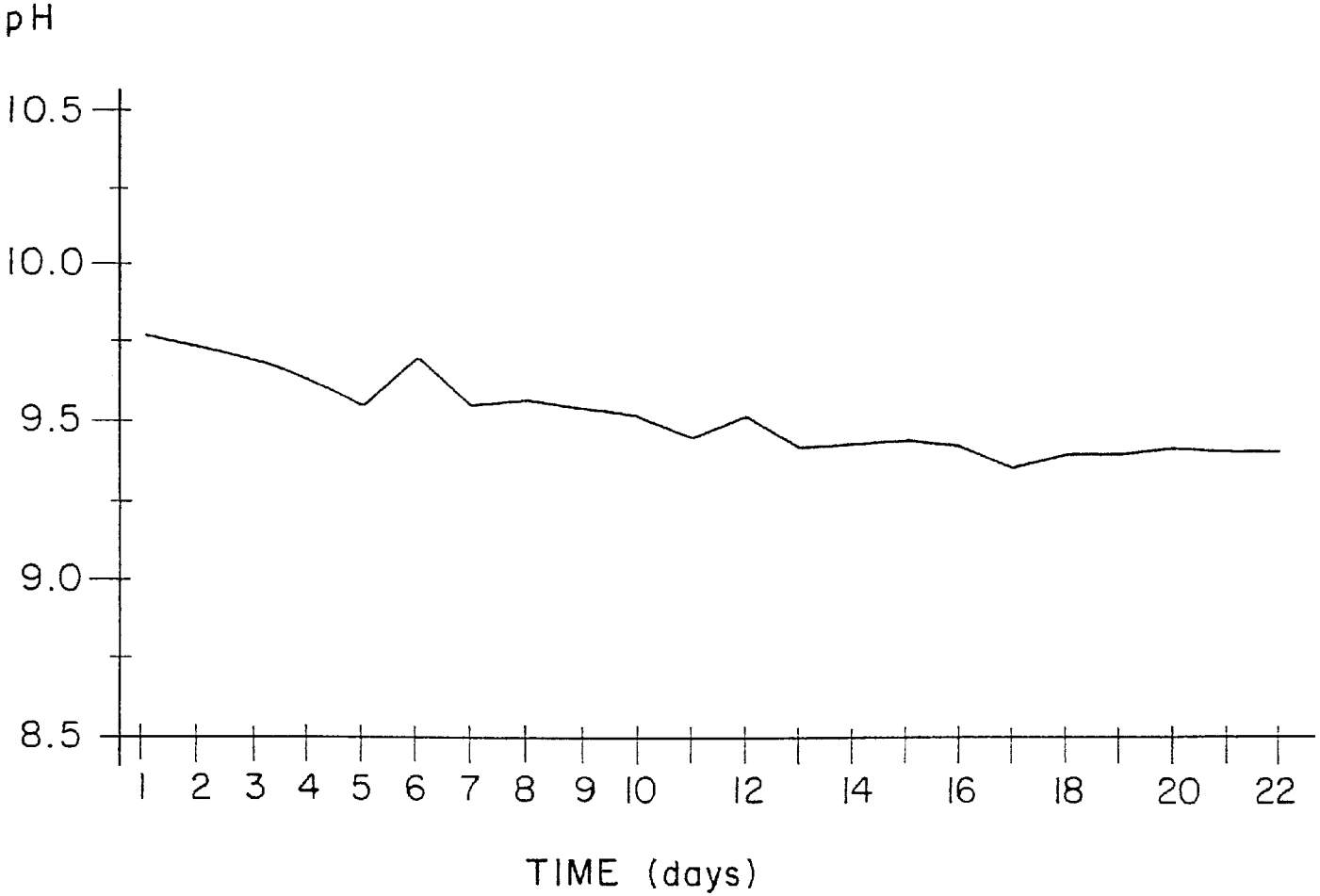
Figure 4:
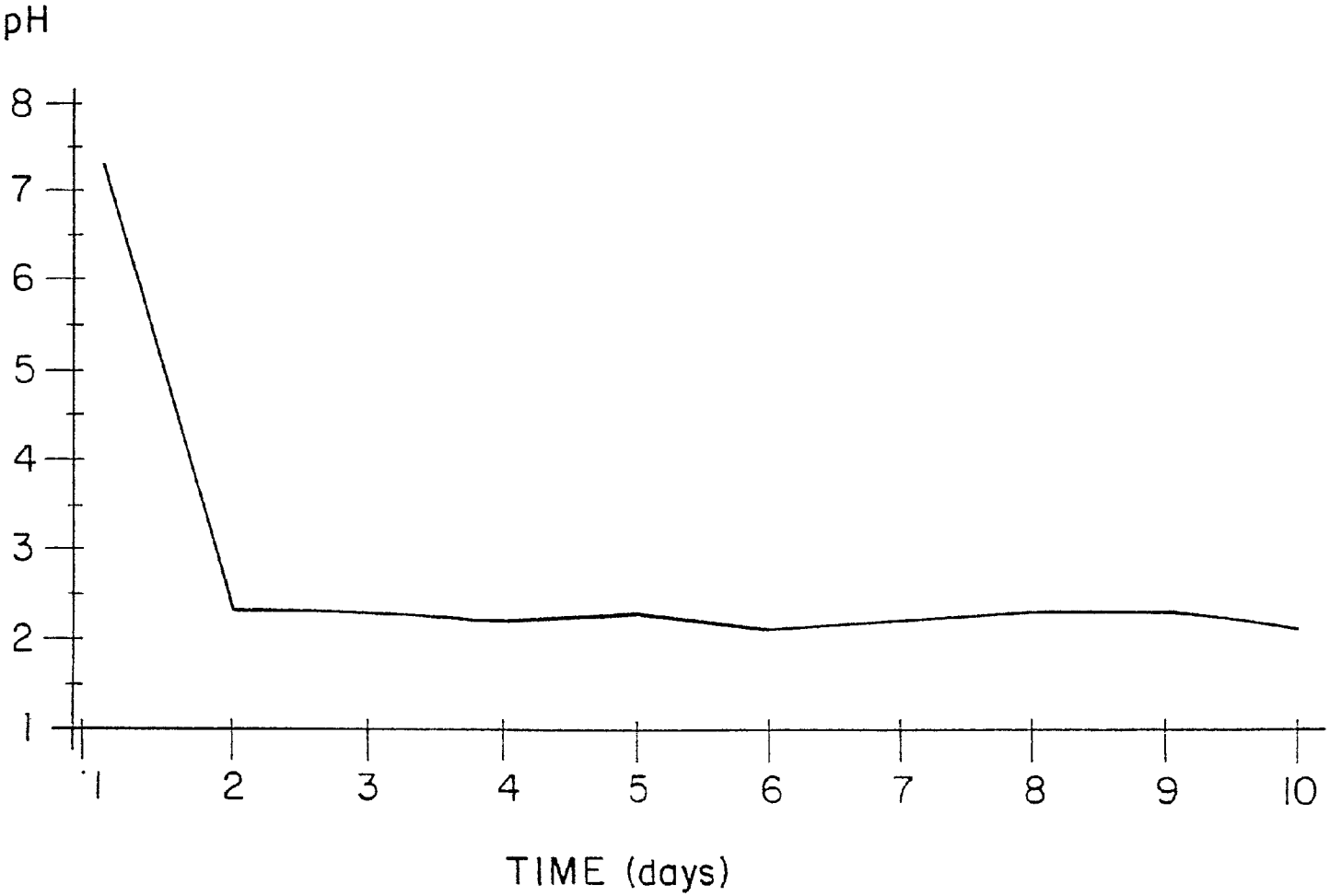
FIG. 4 is a plot similar to that described for FIGS. 1–3 for the commercially available Gateway Syn-ester at an initial pH of 7.95.

One observation noted regarding CHDM diheptanoate, is that when it is placed into water, the pH does not change significantly. If hydrolysis occurred, heptanoic acid would be formed, causing the pH to decrease. When Gateway's Synester is put into water at 10% concentration by weight, the pH drops immediately to below a value of 3, (see FIG. 4) indicating immediate hydrolysis. Additionally, CHDM diheptanoate was placed in water at elevated pH levels of about 8 (7.95 in FIG. 1), 9 (8.91 in FIG. 2) and 10 (9.77 in FIG. 3) through the addition of sodium hydroxide, and observed over a period of days. The pH level decreased only slightly over time, as indicated in the Figures. This is significant in that NaOH is known to catalyze the hydrolysis of esters.

The above lubricant additives can be employed in a variety of lubricants based on diverse oils of lubricating viscosity, including natural and synthetic lubricating oils and mixtures thereof. The esters of the present invention can be used in lubricants or in concentrates. The concentrate contains the esters alone or in combination with other components used in preparing fully formulated lubricants. The concentrate may contain a substantially inert organic diluent, which includes kerosene, mineral distillates or one or more of the oils of lubricating viscosity. Concentrates may contain from 0.01%, or about 0.1%, or about 1% to about 70%, or about 80% or about 90% by weight of the compositions of the present invention. These composition may be present in a final product, blend or concentrate in any amount effective to act as an antiwear agent.

The oil which is used in the preparation of the lubricants of the invention may be based on natural oils, synthetic oils, or mixtures thereof Natural oils include animal oils and vegetable oils (e.g., castor oil, lard oil) as well as mineral lubricating oils such as liquid petroleum oils and solvent treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and inter-polymerized olefins (e.g., polybutylenes, polypropylenes, propylene-isobutylene copolymers, chlorinated polybutylenes, poly(1-hexenes), poly(1-octenes), and mixtures thereof, alkylbenzenes (e.g., dodecylbenzenes, tetradecylbenzenes, dinonylbenzenes, di-(2-ethylhexyl) benzenes, etc.), polyphenyls (e.g., biphenyls, terphenyls, alkylated polyphenyls, etc.), alkylated diphenyl ethers and alkylated diphenyl sulfides and the derivatives, analogs and homologs thereof and the like.

Another suitable class of synthetic lubricating oils that can be used comprises the esters of dicarboxylic acids (e.g., phthalic acid, succinic acid, alkylsuccinic acids, alkenylsuccinic acids, maleic acid, azelaic acid, suberic acid, sebacic acid, fumaric acid, adipic acid, linoleic acid dimer, malonic acid, alkylmalonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(w-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$–$C_{22}$ monocarboxylic acids and polyols and polyol ethers such as neopentyl glycol, trimethylolpropane, pentaerythritol, dipentaerythritol, tripentaerythritol, etc.

Silicone based oils such as polyalkyl, polyaryl, polyalkoxyl or polyaryloxy-siloxane oils comprise another useful class of synthetic lubricants (e.g., tetraethylsilicate, tetraisopropylsilicate, tetra-(2-pentoxy)disiloxane, poly (methyl)siloxanes, poly(methylphenyl)siloxanes, etc.). Other lubricating oils include liquid esters of phosphorus-containing acids (e.g., tricresyl phosphate, trioctyl phosphate, diethyl ester of decanephosphonic acid, etc.), polymeric tetrahydrofurans and the like.

Unrefined, refined and re-refined oils, either natural or synthetic, as well as mixtures of two or more of any of these) of the type disclosed can be used in the concentrates of the present invention. Unrefined oils are those obtained directly from a natural or synthetic source without further purification treatment. For example, a shale obtained directly from retorting operations, a petroleum oil obtained directly from primary distillation or ester oil obtained directly from an esterification process and used without further treatment would be an unrefined oil. Refined oils are similar to unrefined oils except they have been further treated in one or more purification steps to improve one or more properties.

The oil of lubricating viscosity is generally present in a major amount (i.e., an amount greater than 50% by weight). Preferably, the oil of lubricating viscosity is present in an amount greater than about 60%, preferably 70%, more preferably 80% by weight. In a most preferred embodiment of this invention, the oil of lubricating viscosity is present in an amount greater than 90%, and in some instances, in an amount greater than 95%.

Where the lubricant is to be used in the form of a grease, the lubricating oil generally is employed in an amount sufficient to provide the balance of the total grease composition and generally, the grease compositions will contain various quantities of thickening agents and other additive components to provide desirable properties. The esters are present in an amount of from about 0.5% to about 10% by weight, more preferably from 1% to about 10% by weight.

A wide varieties of thickeners can be used in the preparation of the greases of this invention. The thickeners are employed in an amount from about 0.5 to about 30%, more preferably from 3 to about 15% by weight of the total grease composition. Exemplary thickeners would include alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmitic acid, myristic acid, cottonseed oil acids and hydrogenated fish oils.

Other thickeners include salt and salt-soap combinations such as calcium stearate-acetate, barium stearate-acetate, calcium stearate-caprylate-acetate complexes, calcium salts and soaps of low, intermediate, and high molecular weight acids and of nut oil acids, aluminum stearate and aluminum complex thickeners. Additional examples would include clays, either naturally occurring, or chemically modified. These clays are crystalline complex silicates, the exact composition of which is not subject to precise description. In generally, they are complex inorganic silicates such as aluminum silicates, barium silicates and the like, containing, in addition to the silicate lattice, varying amounts of cation-exchangeable groups such as sodium. Hydrophilic clays which are particularly useful for conversion to the desired thickening agents include montmorillonite clays, such as bentonite, attapulgite, hectorite, illite, saponite, sepiolite, biotite, vermiculite, zeolite clays and the like.

This invention also includes aqueous compositions characterized by an aqueous phase with at least one reaction ester product dispersed or dissolved in the aqueous phase. Preferably, this aqueous phase is a continuous aqueous phase although, in some embodiments the aqueous phase can be a discontinuous phase. These aqueous compositions usually contain at least about 25% by weight water. Such aqueous composition encompass both concentrates containing about 25% to about 80% by weight, preferably from about 40% to about 65% water. The esters are generally present in the aqueous compositions in an amount of from about 0.2% to about 10% by weight and optionally include conventional additives commonly employed in water-based functional fluids such as surfactants, thickeners, oil-soluble, water-insoluble functional additives such as dispersants, corrosion-inhibitors, shear stabilizing agents, bactericides, dyes, water-softeners, odor masking agents, antifoam agents, etc. The water-based functional fluids may be in the form of solutions, or micelle dispersions or microemulsions which appear to be true solutions.

Often the aqueous compositions of this invention contain at least one thickener, such as a polysaccharide, or a synthetic thickening polymer or mixtures thereof. Specific examples would include gums such as gum agar, guar gum, gum arabic, algin, dextrans, xanthan gum and the like. Also among the polysaccharides which are useful as thickeners are cellulose ethers and esters, including hydroxyhydrocarbylcellulose and hydrocarbylhydroxycellulose and salts thereof. Representative polymeric thickeners include polyacrylates, polyacrylamides, hydrolyzed vinyl esters, water-soluble homo and interpolymers of acrylamidoalkane sulfonates containing at least 50 mole percent of acrylamidoalkane sulfonate and other comonomers such as acrylonitrile, styrene or the like.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A lubrication process comprising the steps of:

(a) combining water and an ester of generic description shown below;

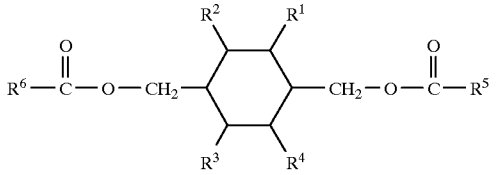

wherein $R^1$ through $R^4$ are independently selected from the group hydrogen and $C_{1-24}$ hydrocarbyl groups; and $R^5$ and $R^6$ are independently selected from the group $C_{3-6}$ hydrocarbyl groups, thereby forming a lubricant composition comprising said water and said ester; and (b) providing a film of said lubricant composition between two surfaces which are moving with respect to each other.

2. The process of claim 1 wherein $R^1$ through $R^4$ are independently selected from the group hydrogen and $C_{1-24}$ alkyl groups and $C_{1-24}$ cycloalkyl groups; and $R^5$ and $R^6$ are independently selected from the group $C_{3-6}$ alkyl groups.

3. The process of claim 2 wherein $R^1$ through $R^4$ are hydrogen; and $R^5$ and $R^6$ are independently selected from the group $C_{3-6}$ alkyl groups.

4. The process of claim 2 wherein the composition is selected from the group consisting of

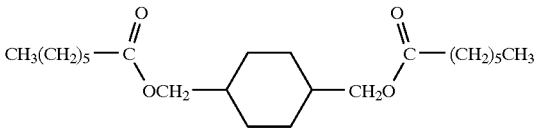

cyclohexanedimethanol diheptanoate; and

-continued

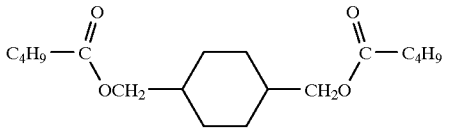

cyclohexanedimethanol butyrate.

5. A lubrication process comprising the steps of:

(a) combining a substantially inert organic diluent; and an ester of generic description shown below;

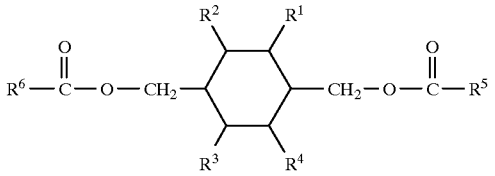

wherein $R^1$ through $R^4$ are independently selected from the group hydrogen and $C_{1-24}$ hydrocarbyl groups; and $R^5$ and $R^6$ are independently selected from the group $C_{3-6}$ hydrocarbyl groups, thereby forming a lubricant composition comprising said lubricating oil and said ester; and (b) providing a film of said lubricant composition between two surfaces which are moving with respect to each other.

6. The process of claim 5, wherein $R^1$ through $R^4$ are independently selected from the group hydrogen and $C_{1-24}$ alkyl groups and $C_{1-24}$ cycloalkyl groups; and $R^5$ and $R^6$ are independently selected from the group $C_{3-6}$ alkyl groups.

7. The process of claim 6 wherein $R^1$ through $R^4$ are hydrogen, and $R^5$ and $R^6$ are independently selected from the group $C_{3-6}$ alkyl groups.

8. The process of claim 7 wherein the composition is selected from the group consisting of

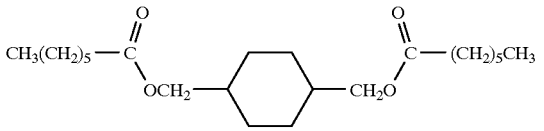

cyclohexanedimethanol diheptanoate; and

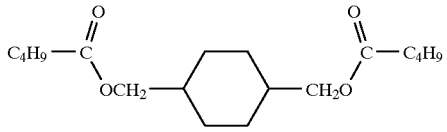

cyclohexanedimethanol butyrate.

9. A process according to claim 5 wherein said composition comprises a major amount of said oil and a minor amount of said ester.

10. A process according to claim 5 wherein said composition further comprises a thickening agent.

11. A process according to claim 1, further including the step of forming a concentrate comprising said ester and water prior to step (a).

12. A process according to claim 11 wherein said concentrate contains about 25% to about 80% by weight water and said lubricant composition comprises about 0.2% to about 10% by weight of said ester.

13. A process according to claim 5, further including the step of forming a concentrate comprising said ester and an organic diluent prior to step (a).

14. The process of claim 13 wherein said ester is present in an amount of at least 0.01% by weight.

15. The process of claim 14, wherein said ester is present in said concentrate in an amount of at least 1% by weight.

16. The process of claim 15 wherein said ester is present in said concentrate in an amount of at least 70% by weight.

* * * * *